US011564447B1

(12) United States Patent
Lamothe

(10) Patent No.: US 11,564,447 B1
(45) Date of Patent: Jan. 31, 2023

(54) SMART SHOE AND METHOD USING

(71) Applicant: Christina Lamothe, San Antonio, TX (US)

(72) Inventor: Christina Lamothe, San Antonio, TX (US)

( * ) Notice: Subject to any disclaimer, the term of this patent is extended or adjusted under 35 U.S.C. 154(b) by 0 days.

(21) Appl. No.: 17/470,862

(22) Filed: Sep. 9, 2021

Related U.S. Application Data

(60) Provisional application No. 63/076,376, filed on Sep. 9, 2020.

(51) Int. Cl.

| | |
|---|---|
| ***A43B 21/42*** | (2006.01) |
| ***A43B 7/38*** | (2006.01) |
| ***A43B 7/16*** | (2006.01) |
| ***A43B 3/34*** | (2022.01) |

(52) U.S. Cl.
CPC ..... *A43B 21/42* (2013.01); *A43B 3/34* (2022.01); *A43B 7/16* (2013.01); *A43B 7/38* (2013.01)

(58) Field of Classification Search
CPC ..... A43B 21/42; A43B 21/437; A43B 3/34; A43B 3/48; A43B 3/0005; A43B 7/38
See application file for complete search history.

(56) References Cited

U.S. PATENT DOCUMENTS

| | | | | |
|---|---|---|---|---|
| 10,750,818 | B2 * | 8/2020 | Rogers | A43B 21/30 |
| 2015/0157087 | A1 * | 6/2015 | Blumenthal | A43B 21/24 36/100 |
| 2017/0213095 | A1 * | 7/2017 | Li | A61B 5/117 |
| 2017/0340051 | A1 * | 11/2017 | Rogers | A43B 13/16 |

FOREIGN PATENT DOCUMENTS

| | | | |
|---|---|---|---|
| CN | 1849956 | A * | 10/2006 |
| CN | 108903118 | A * | 11/2018 |

* cited by examiner

*Primary Examiner* — Ted Kavanaugh
(74) *Attorney, Agent, or Firm* — Troy & Schwartz, LLC; Susan Dierenfeldt-Troy

(57) ABSTRACT

A smart shoe has a height-adjustable heel having a plurality of co-axially oriented, concentric cylindrical wall sections of progressively different diameters comprising a skeleton framework. The wall sections are extendable from a collapsible position wherein the wall sections substantially completely overlap in an axial direction to an extended position wherein the walls sections are extended in an axial direction. Heel height is determined by the number of uncollapsed wall sections. A controller element provides incremental heel height adjustments through the sequential collapse of one wall section at a time starting with the uppermost wall section. The smart shoe includes reversibly expandable components for automatically modifying its width, length, and arch support height to provide an optimal fit of both shoes comprising the pair of smart shoes at every selected heel height.

23 Claims, 15 Drawing Sheets

10

10

10V

5C

5D

SMART SHOE AND METHOD USING

This application claims priority to provisional patent application 63/076,376.

BACKGROUND OF THE INVENTION

The wearing of high heeled shoes is a well-known risk factor for foot-related medical problems ranging from painful bunions to actual foot, ankle, or leg fractures. These problems occur because, unlike flat-heeled shoes, high heels cause undue stress on the front of the wearer's foot as she tries to maintain her balance while walking. Accordingly, high heeled shoes interfere with the anatomically desirable even distribution of weight throughout the foot while walking. The higher the heel, the greater the undesirable weight differential from the back to the front of the foot.

Despite these recognized problems, the popularity of high heels, including stiletto heels, is unlikely to wane. High-heeled shoes are often purchased and worn on the basis of their aesthetic appeal with little consideration to their "practical" comfort. For example, a business woman working in the city may need to walk some distance to and from her parked car or public transportation to her office building. Flat or low-heeled shoes are safer for walking any substantial distance because high heeled shoes interfere with both the wearer's balance and walking speed. Yet, while at the office or social gathering, women may prefer or even be required to wear high-heeled shoes due to the culturally ingrained perception that high-heeled shoes are more attractive and sophisticated relative to their flatter-heeled counterparts.

To address the effect of high heels on foot health and safety, a shoe wearer may transport different pairs of shoes to accommodate her various activities during the day. This approach has the disadvantages of requiring the user: 1) to carry additional cumbersome tote bags or bulky purses large enough to hold at least one extra pair of shoes selected on the basis of the shoe wearer's presumed schedule for the day; and 2) to find a convenient place to change from one pair of shoes to another, preferably while sitting.

A chair or bench may not be available for sitting when a show wearer desires to swap one pair of shoes for another pair. Standing is not the preferred position for inserting shoes onto feet for reasons ranging from potential injury resulting from balancing on one foot to difficulty in correctly securing the foot completely into the shoe. Many women also prefer smaller handbags roomy enough to transport their smart phones, credit cards, and keys, but not roomy enough to transport bulky items like shoes.

Finally, shoe wearers typically rely on only two shoe-size indicators when shopping for shoes: foot length and foot width. Narrow shoe widths such as AA are very difficult to find in today's market place. Generally, both on-line and brick-and-mortar retailers sell only B widths, and there is even a variation among manufacturers over their shoes' actual B width dimensions. With loose-fitting shoes, the wearer may find herself squeezing the front of her foot to help keep the shoe in place, thereby potentially causing foot-related problems. Individuals with high arches have an even more difficult time in finding comfortable shoes from flats to high heels.

In today's market place, "perfect fit" shoes are generally only achievable through custom made shoes designed specifically for the customer's feet whether as a high heeled-shoe or a flat-heeled shoe. There is thus a need for a shoe to resolve the foot health and safety shortcomings of high heels and at the same time provide a comfortable shoe fit. The present invention achieves these two objectives by providing a smart shoe capable of undergoing incremental height adjustments through an automatically collapsible and extendable heel, thereby allowing the wearer to quickly alter the shoe's heel height depending upon the particular preferences and the walking environment she finds herself in. The shoe further provides for incremental width and length adjustments to ensure the best possible fit no matter the user's selected heel height.

BRIEF DESCRIPTION OF THE INVENTION

To achieve its heel-height adjustment benefit, the invention comprises a smart shoe having a height-adjustable heel having a skeleton framework element comprised of a plurality of co-axially oriented, concentric, electronically collapsible and extendable cylindrical wall sections of progressively different diameters. The skeleton framework element is substantially hidden from view by an affixed strong, flexible outer skin element which also provides the heel's aesthetic appeal and contributes to the heel's strength.

Changes in the smart shoe's adjustable heel are achieved through a remote-control, smart phone application ("APP") or other electronic height controller capable of remotely controlling the smart shoe's wireless spring motor 230 or other suitable motor which drives the collapsing of and extension of the skeleton framework element's cylindrical wall sections to achieve a modified heel height. Sensors embedded within the height-adjustable heel provide data to the electronic height controller regarding the positioning of the cylindrical wall sections during heel adjustment. The height-adjustable heel is capable of undergoing conversion into a short flat heel as the result of the step-wise collapse of all of the provided collapsible wall sections.

The smart shoe also comprises strategically placed thickness-adjustable cushions or pads for allowing the user to maximize the fit and comfort of each individual shoe comprising the pair of smart shoes. For example, many individuals have a slight difference between the lengths of the lengths of their feet and/or the widths of their feet. It is thus not uncommon for an individual to find that one member of a pair of shoes fits better than the other one. Generally, these annoying fit problems can only be solved through custom-made shoes. The smart shoe overcomes fit problems through the inclusion of inflatable cushions having a rechargeable battery-operated air pump capable of remotely interacting with the electronic controller to automatically fill with air to reduce any empty space between the user's heel and/or sides of her feet and the sides of the smart shoe through the expansion or retraction of the inflatable length, the width adjustment cushions or both.

A person's natural foot arch, the area along the bottom of the foot between the foot's ball and heel, is susceptible to pain and a shoe's heel height can impact just how much pain is centered in the arch. Arches are generally described as being high, medium, or low. The higher the arch, the greater the likelihood that a gap will exist between the shoe wearer's arch and the shoe. Persons with a high arch are often limited in their selection of suitable shoes. The invention addresses the arch support problem through the inclusion of an inflatable arch support cushion operating by the same expansion and retraction mechanism as described for the inflatable length and width adjustment cushions.

Another problem with particularly high heels is that they shift the distribution of weight to the front of the foot, potentially causing alignment issues between the wearer's hips and knees and undue pressure on the bottom of the foot. The invention's electronic controller includes the ability to alert the user to the height-adjustable heel's maximum recommended height for minimizing these problems depending upon the heel's height, the user's body weight, and the user's foot health history.

As is more fully described below, the invention provides an integrated approach to providing a smart shoe that is readily adaptable to each wearer's specific needs and preferences without sacrificing style and aesthetic appeal. Although the invention is discussed primarily with respect to women's high-heeled shoes, it should be understood that the invention and the disclosed embodiments are applicable to any shoe having a heel where it may be desirable to have a heel-height adjustment option.

DETAILED DESCRIPTION OF THE INVENTION

Figure 1:
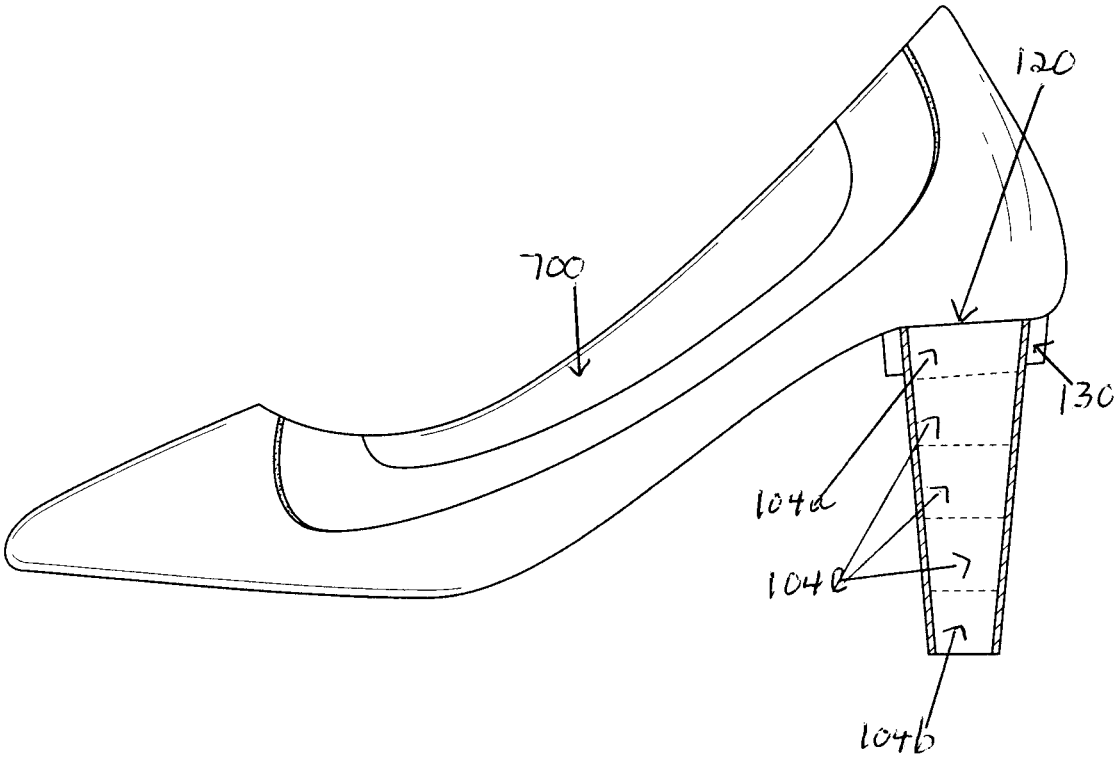
FIG. 1 is perspective cut-away side view of the smart high-heeled shoe showing the invention's fully extended adjustable heel comprising a fully extended skeleton framework element having a total of four cylindrical collapsible wall sections. The top wall section is affixed to an external wall anchoring element.

The present invention will now be described in detail with reference to a few embodiments thereof as illustrated in the accompanying drawings. Referring to FIGS. 1, 2, 3, and 4, smart shoe 10 comprises height-adjustable heel 100 having a skeleton framework element 102 with a plurality of co-axially oriented, concentric cylindrical wall sections 104 of progressively decreasing diameters and an external collapsed wall section anchoring unit 130. Cylindrical wall sections 104 are extendable from a collapsed position wherein the wall sections 104 substantially overlap in an axial direction with any previously collapsed wall sections to an extended position wherein the cylindrical wall sections do not substantially overlap in an axial direction. The cylindrical wall sections 104 include at a minimum one top wall section 104*a* having a proximal lip 105 and one bottom wall section 104*b* terminating in a solid base 107. In an embodiment, the top and bottom wall sections 104*a* and 104*b* may be separated by one or more middle wall sections 104*c*.

Cylindrical wall sections 104 are contiguous with their adjacent cylindrical wall sections with all wall sections having an inner surface 110*a* and an outer surface 110*b* separated by a gap 112 running from top cylindrical wall section 104*a* all the way to solid base 107. Gap 112 has at least one pair of oppositely disposed reversibly retractable cords 114*a* and 114*b* lengths substantially equal to entire length of skeleton framework element 102 in its full extended conformation plus an additional length 119 for affixing to roller 220 as disclosed below. The distal ends of 115*a* and 115*b* of each retractable cord 114*a* and 114*b* are affixed to the inside surface of solid base 107. Cords 114*a* and 114*b* follow the contours of the smart shoe's skeleton framework element 102 of gap 112 and may will the entire space separating the inner an outer surface of gap 112.

Cords 114*a* and *b* may be comprised of very strong rope such as polyethylene hollow braid rope or plastic encased wire capable of undergoing smoothing rolling onto and unrolling from roller 220.

The external collapsed wall section anchoring element 130 comprises cylindrical chamber 136 for retaining collapsed wall sections 104 with a proximal solid top face 132 with an outer surface 134*a* and an inner surface 134*b*, the outer surface of 134*a* being permanently affixed to the smart shoe 10's heel seat 120 and an opposite distal opening 138 bordered by edge 140.

Figure 2:
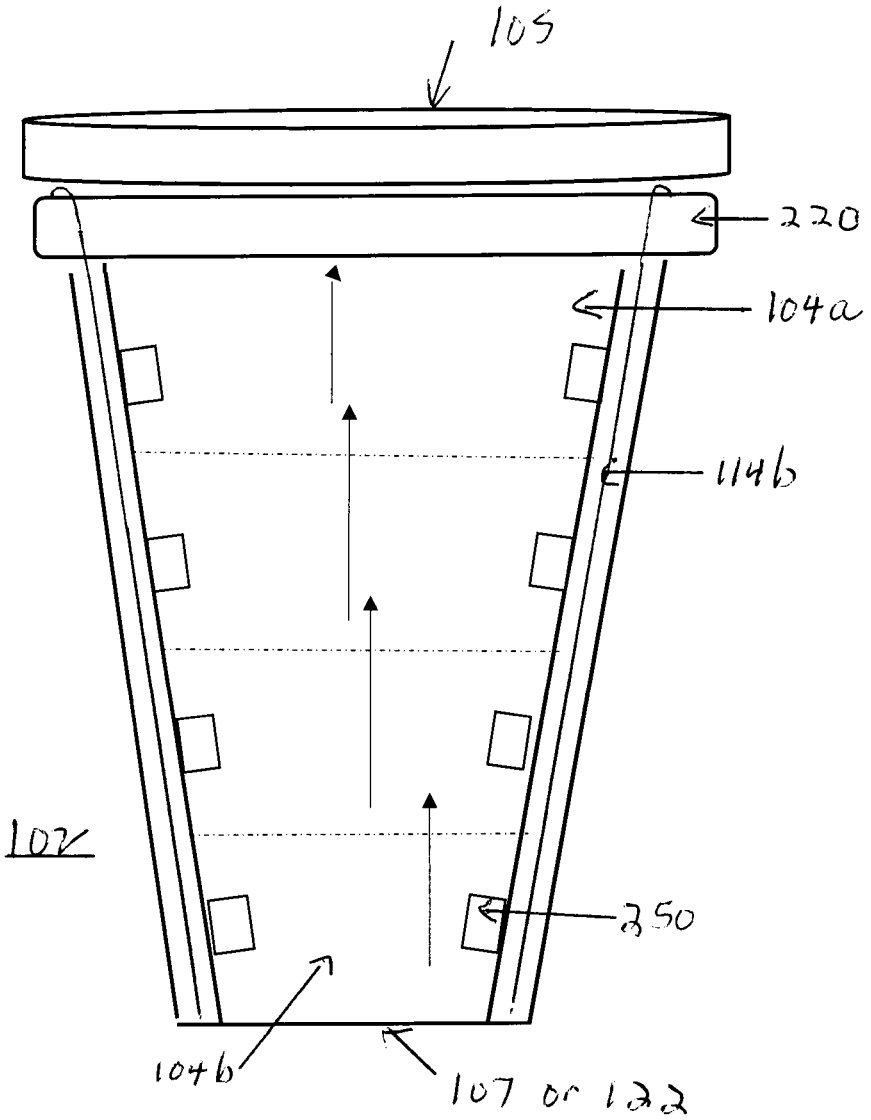
FIG. 2 is front planar view of the smart shoe's fully extended skeleton framework element in the shape of substantially a rectangular cylinder showing a top cylindrical collapsible wall section, two middle cylindrical collapsible wall sections, and a bottom cylindrical collapsible wall section for a total of four collapsible walls.

As shown in FIG. 2, a portion of top wall section 104*a*'s length may be contained within cylindrical chamber 136 when skeleton framework element 102 is in its fully extended position. Distal opening 138 and proximal top solid face 132 are separated by cylindrical chamber 136's curved surface 142 having a length 144 and terminating in edge 140.

Referring again to Fig.!, skeleton framework element 102 is substantially in the shape of a high heel wherein the diameters of cylindrical wall sections 104 gradually decrease from top cylindrical wall section 104*a* to bottom cylindrical wall section 104*b*. Accordingly, skeleton framework element 102 defines the length and overall shape of height-adjustable shoe 10's pre-determined heel style which may range from a chunky type of high heel to a tapered high heel.

Smart shoe 10 with height-adjustable heel 100 is manufactured according to standard shoe-assembly procedures used to attach "regular" heels to a shoe's heel seat. With smart shoe 10, external wall anchoring element 130 is the part height-adjustable heel 100's attached to smart shoe 10's heel seat 120. In assembled smart shoe 10, skeleton framework element 102 is substantially perpendicular to heel seat 120 and cylindrical wall anchoring element 130. Skeleton framework element 102's perpendicular orientation ensures that adjustable heel 100 remains in vertical alignment with a walking surface for all selected heel heights.

Figure 5:
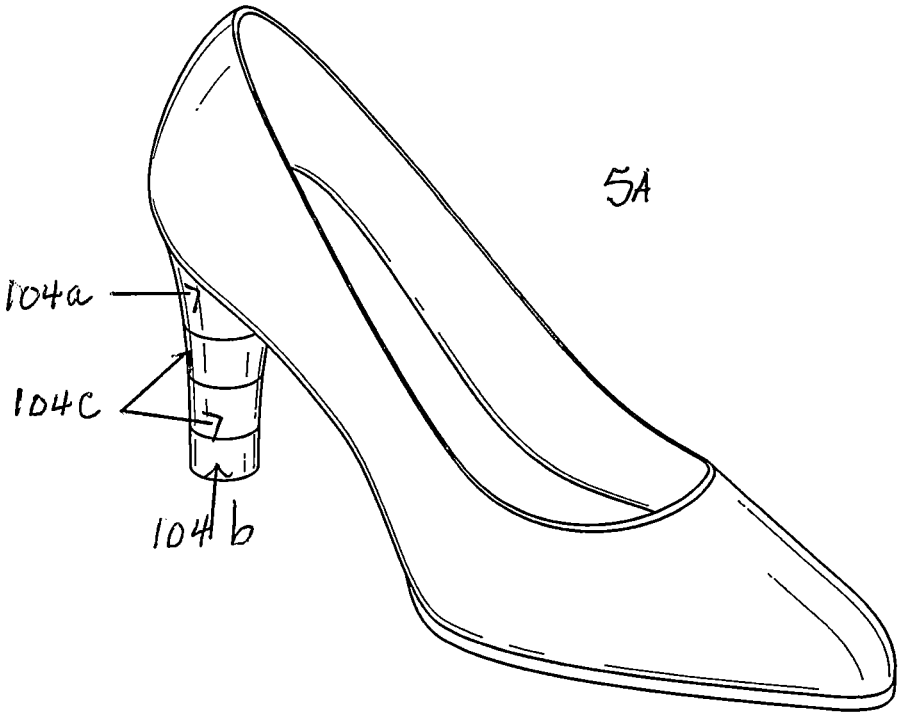
FIG. 5 is a side perspective view of the smart shoe's adjusted heel showing the smart shoe with four different heel heights including a very low flat heel conformation for the embodiment having the external wall anchoring element.
Figure 5:
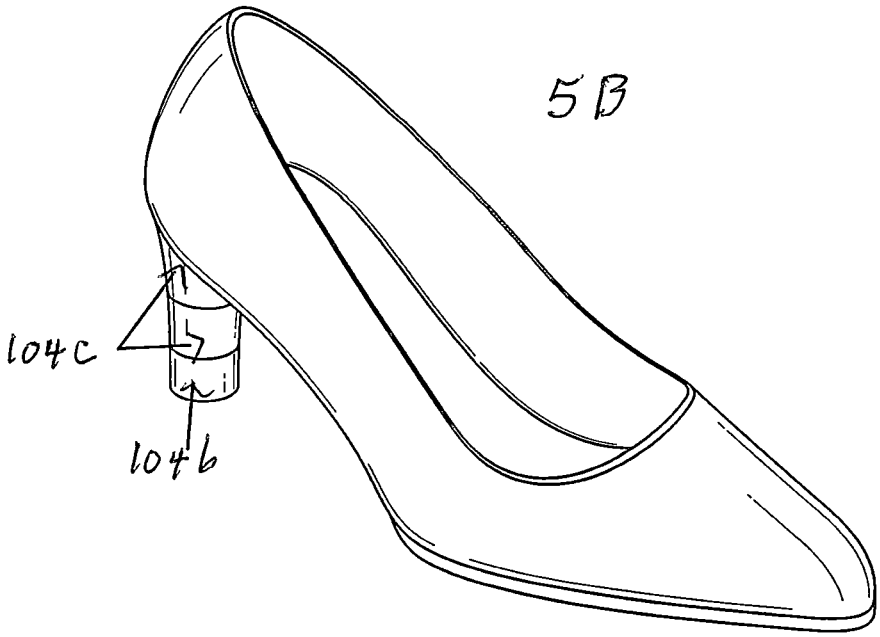
Figure 5:
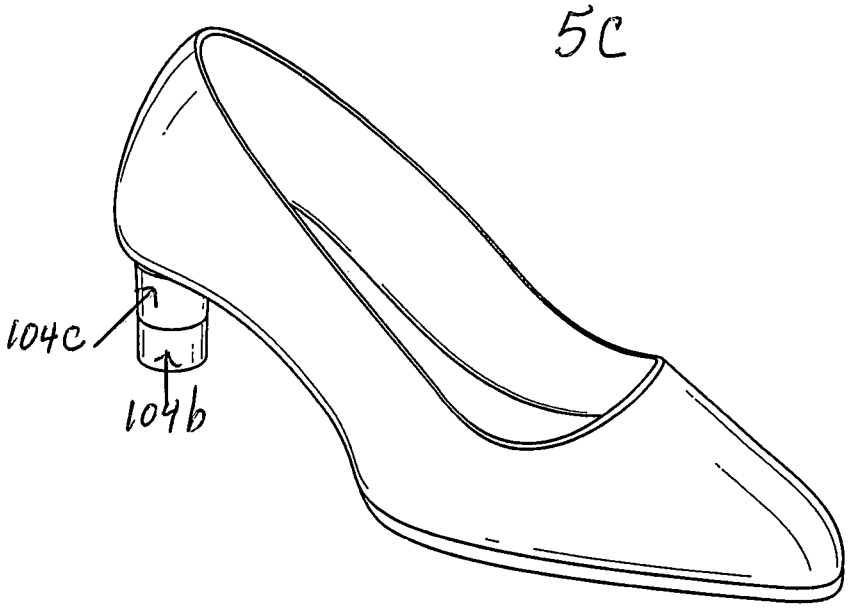
Figure 5:
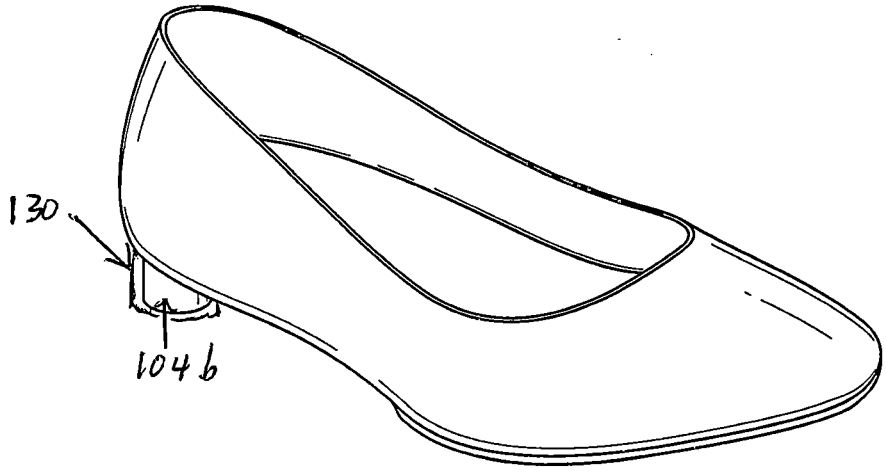
Figure 13:
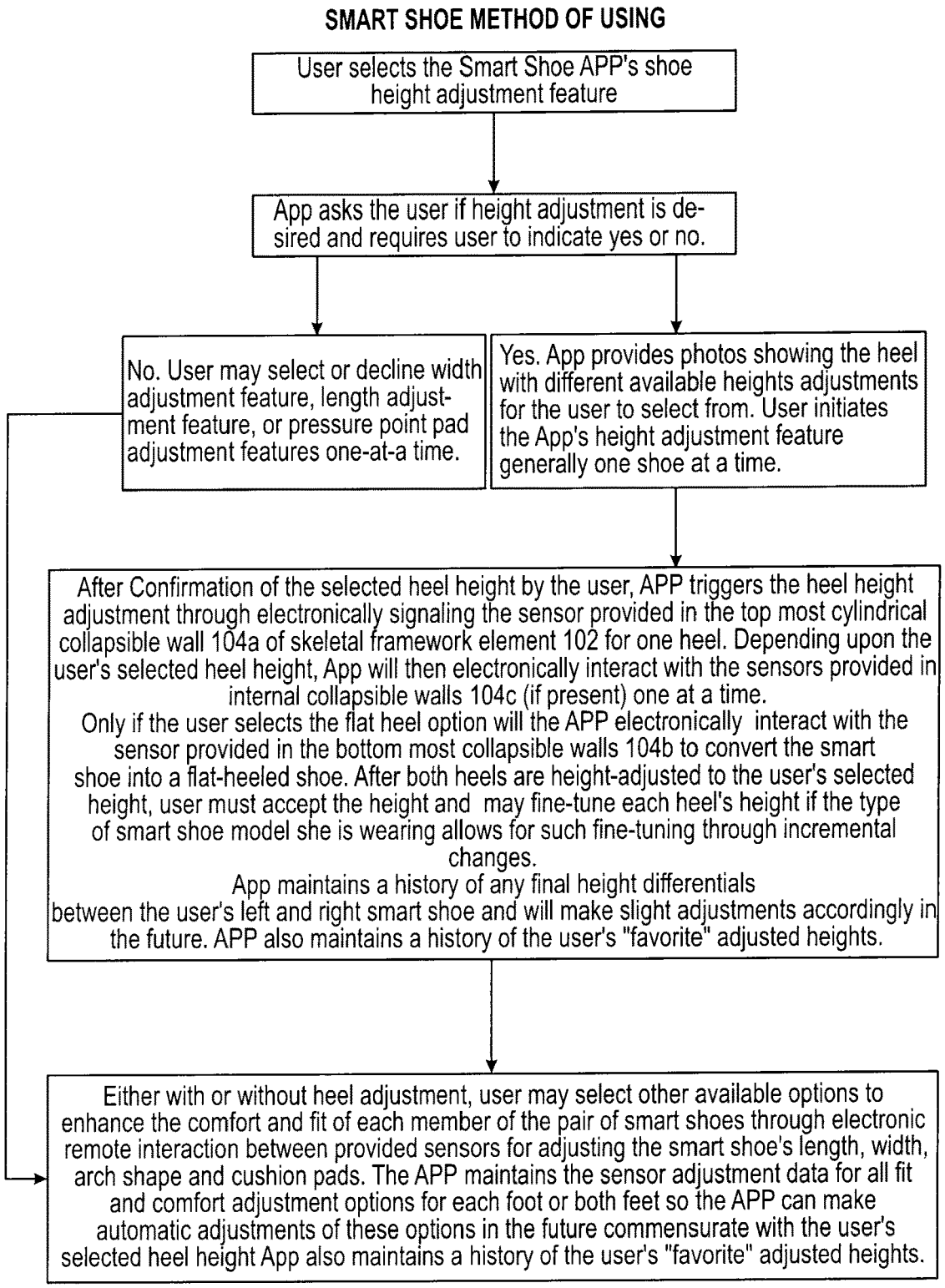
FIG. 13 is a flow diagram summarizing the controller element's automatic steps for carrying out the smart shoe's methodology to obtain its disclosed utilities: heel height adjustment, padded cushion adjustment, and internal length and width adjustment.

Referring again to FIGS. 2, 3, and 5, and now FIG. 13, the shortening of height-adjustable heel 100 commences with the step-by-step collapsing of its cylindrical wall sections 104 starting with top cylindrical wall section 104*a*. Once top wall section 104*a* is collapsed into wall anchoring element's 130's cylindrical chamber 136, additional wall sections 104 may be collapsed sequentially into the collapsed wall section 104 with all collapsed wall sections also being nested within wall section 104*a* as the first and the widest collapsed wall section. The lengthening of a previously collapsed (shortened) heel commences with the step-by-step extension of the last cylindrical wall section 104 to have been collapsed into a fully extended wall section until either the desired intermediate height or the maximum possible height of height-adjustable heel 100 is obtained.

When wall section 104*a* is entirely collapsed, the entire length of wall section 104*a* is enclosed within cylindrical chamber 136. Cylindrical chamber 136 is of sufficient depth to accommodate all collapsed wall sections comprising skeleton framework element 102 and of sufficient width to maintain all collapsed walls in a substantially horizontal position within cylindrical chamber 136. Distal opening 138's diameter is larger than the diameter of wall section 104*a*, the wall section with the largest diameter, to provide for the initial unimpeded collapse of and extension of wall section 104*a* and all subsequently collapsed wall sections 104. When fully collapsed, the smart shoe's height is substantially equal to the length of wall anchoring element 130 and the collapsed wall sections are substantially flush with wall anchoring element's 130's with edge 140 surrounding distal opening 138.

Solid base 107 comprises the smart shoe 10's top piece 122. Top piece 122 is the part of height-adjustable heel that is in contact with the ground for all of smart shoe 10's heel heights except for a fully collapsed skeleton framework element 102. A separate affixed plastic cap may be affixed top piece 122 to minimize wear and tear on top piece during walking (not shown).

As shown in FIG. 13, to achieve a desired heel height adjustment, smart shoe 10 includes a heel height adjustment mechanism 400 for automatically collapsing extended wall extensions 104. The collapsing of or extension of previously collapsed wall sections 104 is controlled through the simultaneous extension of or retraction retractable cords 114*a* and 114*b* according to a preprogrammed distance wherein each preprogrammed distance is substantially equal to the length of the corresponding wall section. For the fully extended heel, the height-shortening mechanism is commenced through the initial collapsing of top cylindrical wall section 104*a* followed by the collapse of the immediately adjacent uncollapsed wall section, e.g., upper-most middle wall section 104(*c*) into collapsed wall section 104*a* and so on until the desired heel height is obtained. Height extension mechanism 400 is commenced through the extension of the last wall section 104 to have been previously collapsed followed by the extension of the immediately adjacent collapsed wall section and so on until the desired heel height is obtained.

Referring again to FIG. 2, to monitor the height adjustment mechanism of adjustable heel 100, skeleton framework element 102 is electronically configured to include one or more sensors 250 affixed to each collapsible wall 104, with each sensor capable of electronically interacting remotely with electronic controller 400 to monitor the heel shortening and lengthening carried out through mechanism 400. Sensors 250 may also be located within wall anchoring element 130. That is, all structural embodiments of height-adjustable heel 100 are readily adapted to include appropriately positioned sensors to facilitate the heel height adjustment mechanism. FIG. 2 shows sensors positioned between skeleton framework 102's outer skin 200 and collapsible sections 104. However, the placement of sensors is not limited to any particular location(s) within skeleton framework 102.

The mechanical element 450 of heel adjustment mechanism 400 relies on a roller 220 having an internal smart wire-free motor (not shown) for driving the rotation of roller 220 in the required forward or backward direction. The internal smart wire-free motor is operated by a rechargeable battery. Roller 220 extends horizontally across skeleton framework element 102 under solid top face 105. The free ends 123*a* and 123*b* of retractable cords 114*a* and b are affixed to the ends of roller 220 to provide the connecting means required for collapsing cylindrical wall sections 104 as disclosed for mechanism 400 above. Accordingly, as cylindrical wall sections 104 are collapsed, retractable cords 114*a* and 114*b* are shortened as the result of being wound around roller 220, causing the simultaneous collapsing of a selected wall section pursuant to heel adjustment mechanism 400 and the smart shoe's controller element 300. When heel lengthening is desired, roller 220's directional rotation is reversed to cause the simultaneous lengthening of retractable cords 114*a* and 114*b*.

In another embodiment, proximal solid top face 132 includes at least one pair of oppositely disposed apertures 145*a* and 145*b* wherein each aperture is aligned with a free end 123*a* or 123*b* of retractable cord 114*a* or 114*b* for slidingly aligned free end 123*a* or 123*b* of aligned retractable cords 114*a* or 114*b*. Roller 120 is affixed to the inside surface of anchoring wall element 130. Free ends 123*a* and 123*b* of retractable cords 114*a* and 114*b* are affixed to roller 220.

Heel mechanism 400's automatic changes in the heel's vertical height 140 are achieved through an electronic regulator 300 provided as remote-control element 420 or a separate smart phone application (APP) 440 wherein both are configured to receive and send signals to the smart wire-free motor to cause the rotation of roller 220 to achieve shortening or lengthening of height-adjustable heel 100 by causing the simultaneously shortening of retractable cords 114*a* and 114*b* which in turn cause the vertical upward collapsing or the downward vertical extension of previously collapsed cylindrical wall sections 104 according to heel adjustment mechanism 400. Smart phone application 450 may be configured to show images of an adjusted heel which the user can simply click on to initiate the collapsing process or extension process according to the selected image. The smart wire-free spring motor is directed by electronic regulator 300 whichever the case may be, to undergo the number of pre-programmed forward or backward rotations of roller 220 required for achieving the selected adjusted heel height through the simultaneous shortening or lengthening of retractable cords 114*a* and 114*b* to achieve the collapsing or extension of cylindrical wall sections 104. Sensors 250 electronically provide electronic regulator feedback information on the final positions of wall sections 104 following a height adjustment step.

The number of height adjustments available for smart shoe 10 is determined by the number of wall sections 104. The greater the number of cylindrical wall sections 104 provided in the smart shoe, the greater the available height adjustments. For example, if smart shoe 10 with a heel of height X comprises cylindrical wall sections 104*a*, 104*b*, and one cylindrical wall section 104*c*, three adjustments are possible. If another smart shoe 10 of height X has five cylindrical wall sections, more adjustments are obviously available. The latter situation may be particularly apt for users who have slight differences in the leg lengths and would like the ability to have incrementally small height adjustments available. Smart shoe 10 can provide such a utility.

Referring again to FIGS. 2 and 4, the heel height adjustment begins with the height regulator-controlled collapsing of top wall section 104*a* through and into external anchoring retainer wall 130. The top piece 122 of bottom wall section 104*b* will still be the part of height-adjustable heel 100 in contact with the ground because the heel shortening step begins from the top of skeleton framework 104 with the initial collapse of wall section 104*a*. With reference to FIG. 2's illustration, the next collapsible wall section after collapsible wall section 104*a* is the upper most 104*c* wall section, if present. Top piece 122 is the only part of smart shoe 10's heel will remain in contact with a walking surface until skeleton framework element 102 is completely collapsed. With complete collapsing of skeleton framework 102, the smart shoe's heel seat 123 comprises a plurality of all collapsed concentric rectangular or circular shapes 125 wherein top piece 122 is contained within the center.

The heel length for completely collapsed skeleton framework 102 is substantially equal to the length of wall anchoring unit 130. Accordingly, the length of external-wall anchoring element 130 determines the shortest possible heel available upon complete collapsing of skeleton framework element 102.

The width of external wall anchoring element 130 is equal to the sum of the diameter of distal opening 138 and the thickness of the anchoring wall element's curved surface. Collapsed concentric shapes 125, including former top piece 122, do not substantially extend below distal opening 138 and are substantially flush with the bottom edge 146 of external wall anchoring element 130's curved surface 142. Accordingly, the part of the heel of the fully collapsed heel configuration in contract with the walking surface are collapsed concentric shapes 125 and bottom edge 146. As shown in FIG. 1, smart shoe 10 is capable of undergoing conversion into a very flat heel if so desired. For all other adjustments, height-adjustable heel 100 retains the aesthetic appearance of a high heel albeit of shorter heel lengths.

Referring again to FIG. 1, skeleton framework element 102 is further comprised of a strong outer skin layer element 200, which covers substantially the entire outside surface of skeleton framework element 102. Outer skin layer element 200 enhances the attractiveness of height-adjustable heel 100 by hiding the skeleton framework element 102 from view and also renders smart shoe 10 aesthetically pleasing because it can be provided in different colors and/or textures. The curved surface 142 of external wall anchoring unit 130 and also wall anchoring element 130 may also be covered with outer skin element 200. Strong outer skin layer element 200 enhances height-adjustable heel 100's overall strength and ability to retain selected heel adjustments through heel adjustment mechanism 400. Outer skin element 200 protects skeleton framework element 102 and its heel height adjustment sensors 250. As shown in FIG. 2, concentric shapes 125 are separated by outer skin layer element 200.

High heeled shoes are susceptible to heel breakage or even separation of the heel from the sole of the shoe due to too much weight being placed on the high heel. Such heel damage may result in injury to the wearer. Indeed, high-heeled shoes are generally sold without any consideration to the potential user's weight unless they are custom made even though it's the shoe's heel that will absorb most of the wearer's weight. Generally only shoe size is the major consideration (other than the shoe's aesthetic appeal and color) when potential users are trying on new high-heeled shoes or, in today's market place, purchasing on-line.

Smart shoe 10 solves this problem by taking into consideration the effect of the user's weight on height adjustable heel 100's integrity because it can be specifically constructed to accommodate a specified weight range through the selective use of materials comprising skeleton framework element 102 and outer skin layer element 200. The selected materials comprising both the skeleton framework element 102 and outer skin layer 200 are of sufficient strength to support the shoe's specified wearer weight range no matter the selected heel height and may be varied from wall section to wall section. Different wall thicknesses and/or compositions may be used from wall section to wall section for either or both skeleton framework element 102 or outer skin later element 200. Accordingly, the invention provides consumers with the ability to select shoes better adapted to their specific body weight and not just the size of their feet.

Figure 14:
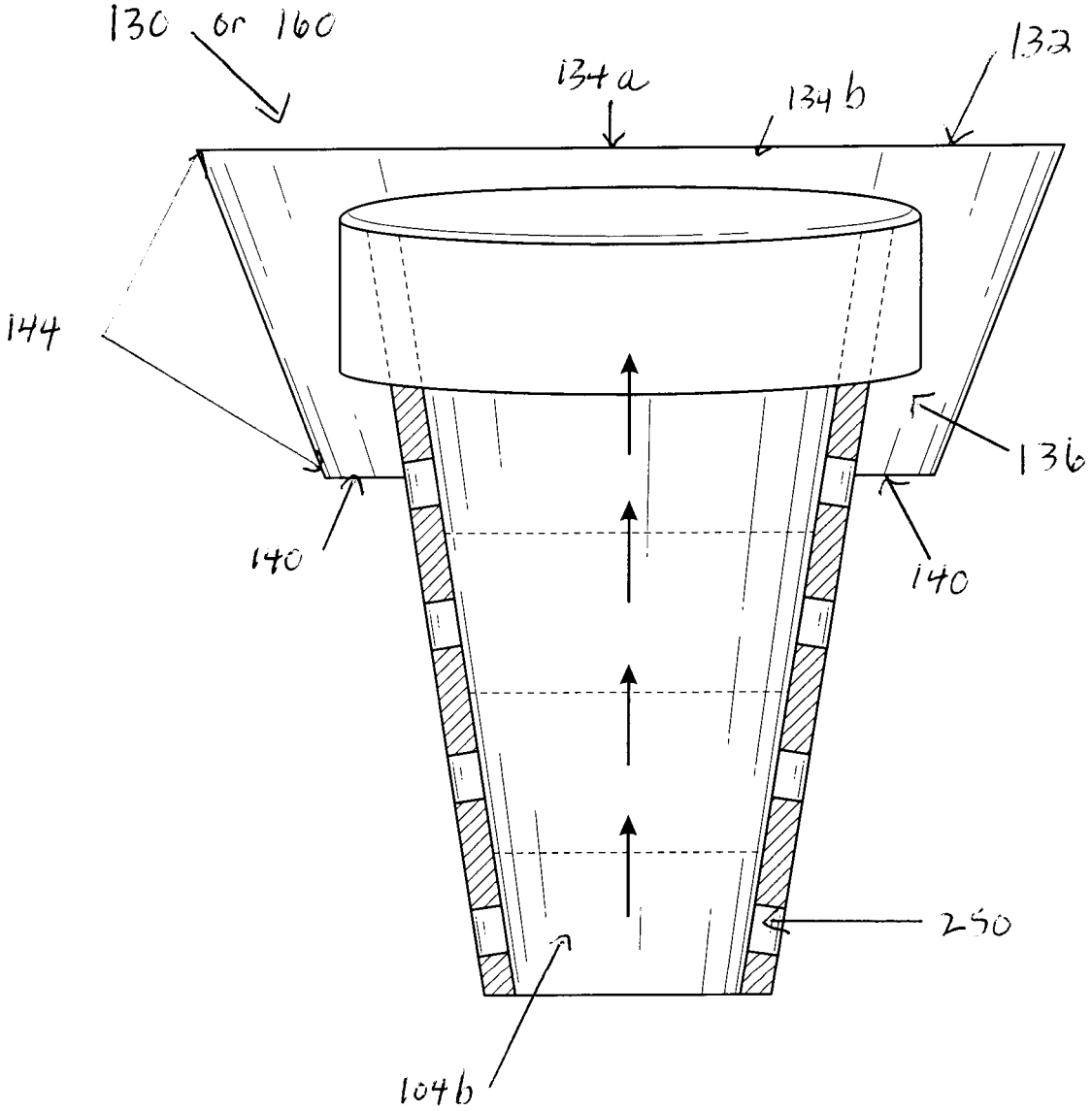
FIG. 14 is a perspective view of the smart shoe with a platform comprising cylindrical chamber positioned above the height-adjustable heel's skeleton framework element. The cylindrical chamber itself be directly affixed to the skeleton framework element or house an internal wall anchoring element to which the skeleton framework element is affixed.

Referring again to FIG. 4 and now to FIG. 14, in another embodiment, the smart shoe 10 comprises a platform 150 extending throughout the entire bottom side of smart shoe 10. Platform 150 comprises smart shoe 10's outer sole. The platform 150's heel seat 190 has a substantially rectangular cylindrical compartment 155 opening into the interior of platform 150's heel seat 190 for encasing an internal wall anchoring element 160. Internal wall anchoring element 160 is substantially contained within cylindrical compartment 155 wherein its distal opening 168 is flush with the platform 150's outer sole. Internal wall anchoring element 160 incorporates the features of external wall anchoring element 130 discussed above except that it is affixed within platform 150's cylindrical compartment 155 instead of being directly attached to smart shoe 10's outer sole. Here, the proximal top side 105 of cylindrical wall section 104*a* is affixed directly to internal wall anchoring element 160.

Alternatively, platform cylindrical compartment 150 itself may entirely replace separate internal wall anchoring element 160 and instead itself function as internal wall anchoring element 170. Here, proximal top side 105 of skeleton framework element 102 is attached directly to the top internal surface of platform wall anchoring element 170's platform cylindrical compartment 155 as shown in FIG. 14B. As with external wall anchoring element 130 the dimensions of cylindrical compartment 155 are sufficient to provide for the unimpeded collapse of wall sections 104 into and their unimpeded extension out of cylindrical compartment 155 via heel mechanism 400. Because all collapsed wall sections are contained with platform 150's interior cylindrical compartment 155, the collapse of all cylindrical wall sections 104 results in a totally flat heel conformation wherein the fully collapsed skeleton element 104 is contained within platform cylindrical compartment 150. This embodiment provides the smart shoe 100 wearer with a completely flat or ballerina type of shoe. As with external wall anchoring element 130, internal wall anchoring element 160 and platform wall anchoring element 170 may also include sensors for monitoring the position of cylindrical wall sections 104 resulting from the collapsing or extension of cylindrical wall sections 104.

Figure 3:
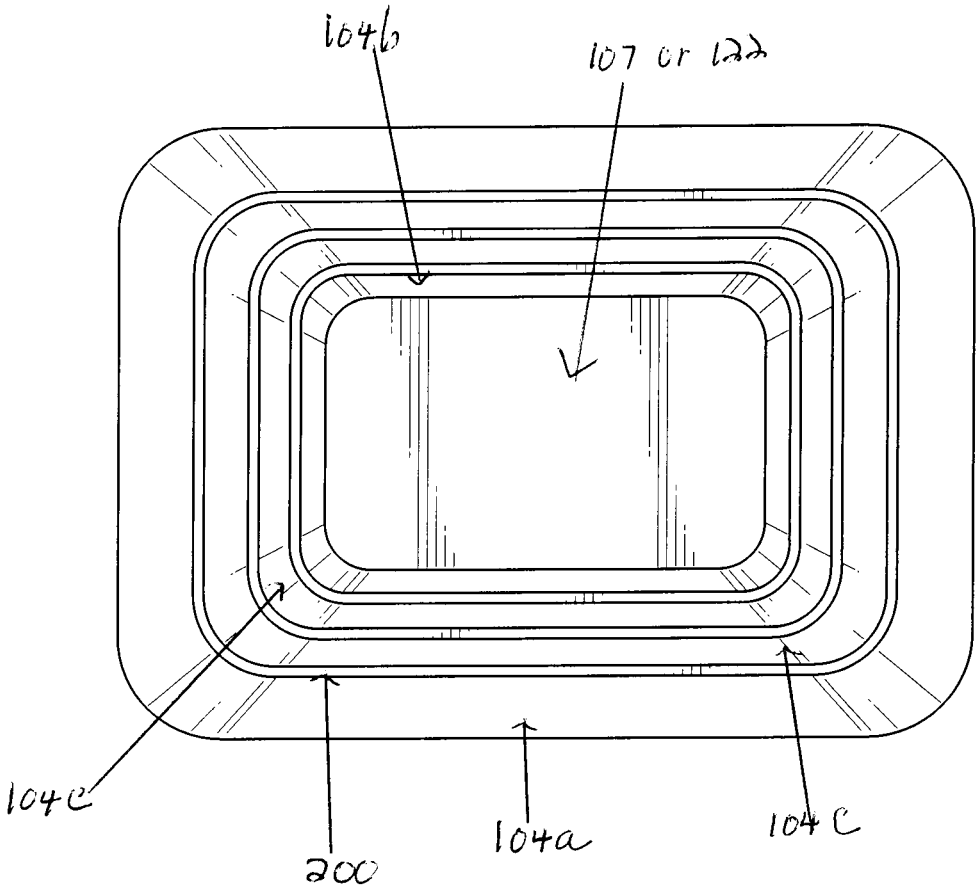
FIG. 3 is bottom planar view of the fully collapsed skeleton framework element shown in FIG. 2.
Figure 4:
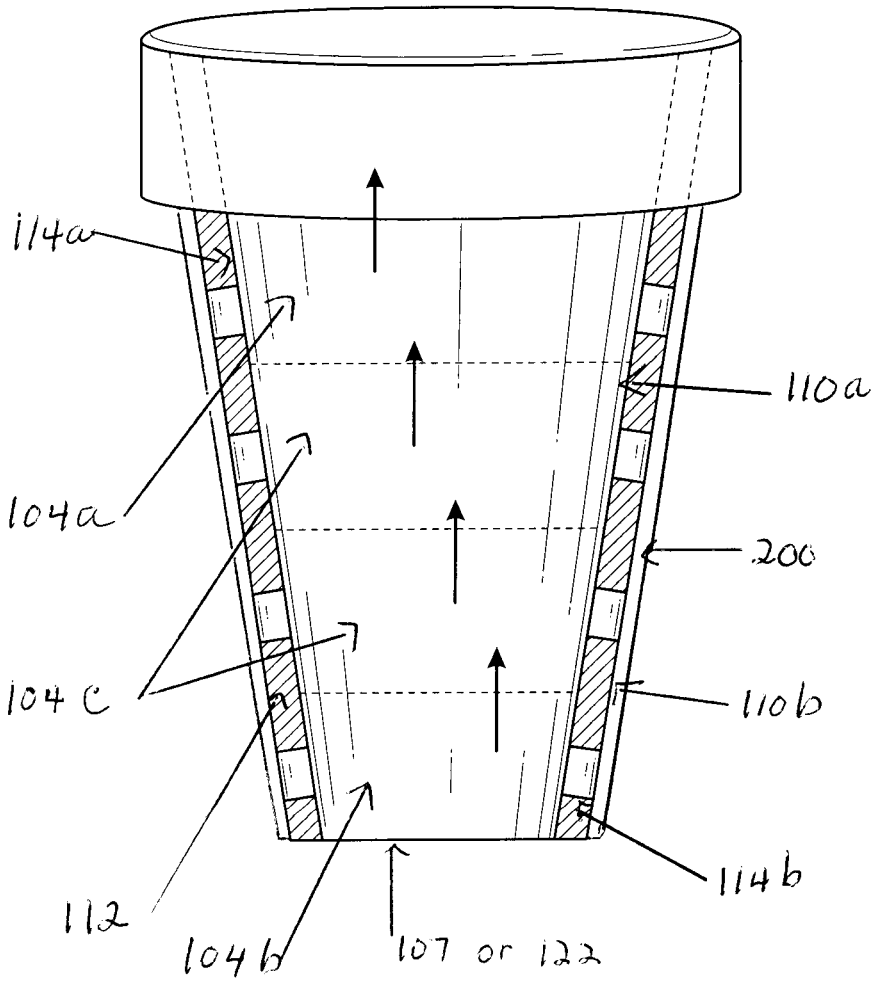
FIG. 4 is a front planar view of the height-adjustable heels having an external wall anchoring element compartment to which the top cylindrical wall section of the skeleton framework element is affixed. The external wall anchoring element is affixed to the outer sole of the smart shoe. In other embodiments, an internal anchoring element is affixed to the smart shoe within a platform provided with the smart shoe and is not visible.
Figure 9:
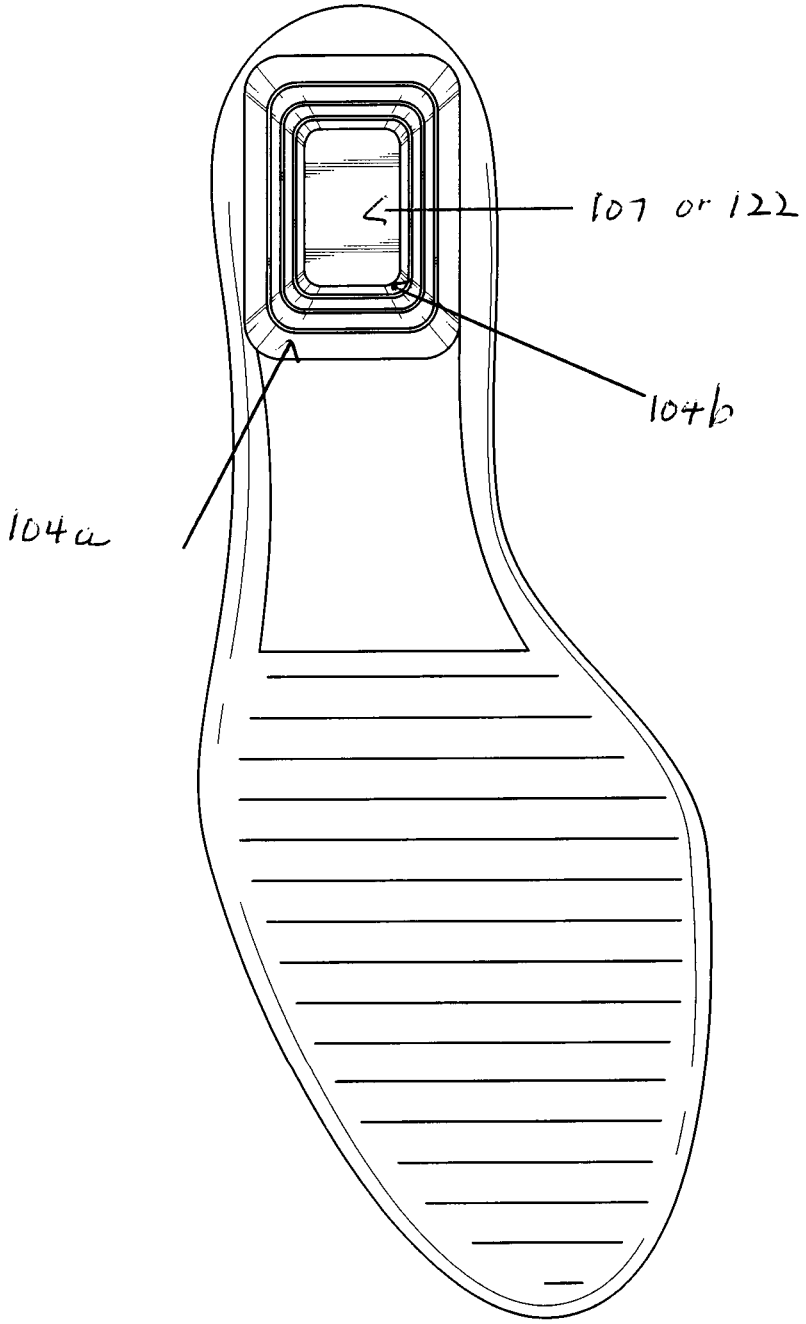
FIG. 9 is a bottom planar view of the shoe having either the internal collapsed wall or the external collapsed wall anchoring element when all of the skeleton framework's collapsible walls segments have been collapsed into the internal heel-anchoring compartment.

Referring again to FIGS. 4 and 5, unless bottom wall section 104*b* is itself fully collapsed, any resulting adjusted heel will comprise an extended but shorter portion of skeleton element 102 protruding from below external wall anchoring element 130, internal wall anchoring element 160 or platform wall anchoring element 170. Bottom collapsible wall section 104*b* provides adjustable heel 100's shortest available heel conformation when all other wall sections 104*a* (and 104*c* walls if present) except 104*b* have been collapsed. FIGS. 3 and 9 show the appearance of collapsed height-adjustable heel 100 wherein top piece 122 is positioned within the center of concentric rectangular or circular shapes 125 resulting from the fully collapsed skeleton framework element 102 for both internal wall anchoring element 160 embodiment or the platform wall anchoring element 170.

Figure 10:
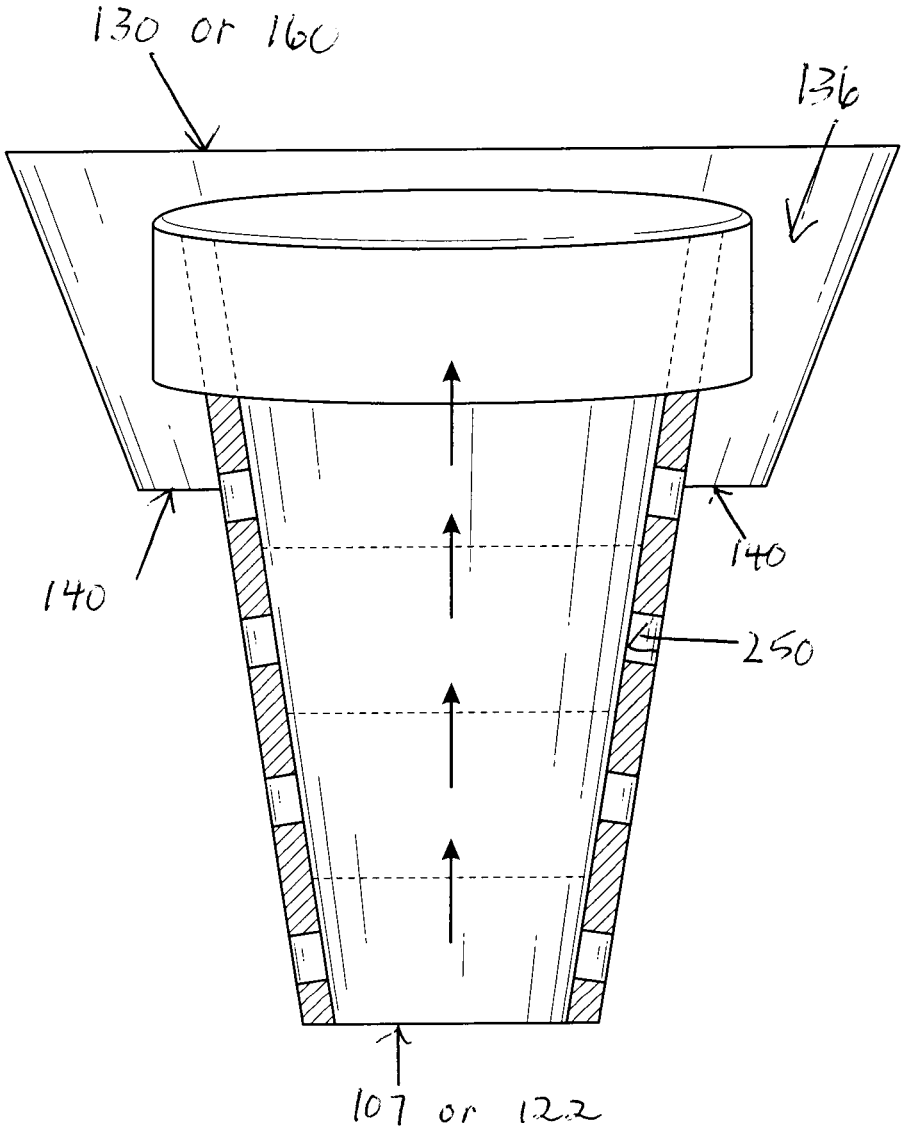
FIG. 10 is a side perspective view of showing a portion of the top of the shoe's skeleton framework extending into the internal wall anchoring compartment. To house the internal wall anchoring compartment, the smart shoe includes a cylindrical chamber contained within the smart shoe's platform and hidden from view.

Referring again to FIG. 4 and now FIG. 10, the visible portion of the smart shoe 10's shortest allowable heel, i.e., when even wall section 104*b* is collapsed, is determined by length of external wall-anchoring compartment 130. With internal wall anchoring element 160 and platform wall anchoring element 170, height-adjustable heel 100 may be transformed into completely flat heel e.g., a ballerina slipper type of heel because all collapsed wall sections 104 are contained with platform 150.

For embodiments with internal wall section anchoring element 160 or 170, roller 220 is affixed to framework skeleton framework element 102 as discussed above for external wall anchoring element 130, namely under the top side of skeleton framework element 105. Disclosed height adjustment mechanism via controller 400 for causing the sequential collapse of cylindrical wall sections 104 also applies these two embodiments.

Top side 105 may instead be provided as a rim 106 instead of a closed top. In this case, roller 220 may be provided above or below rim 106.

Referring again to FIG. 14, controller element 300 drives the collapse of cylindrical wall sections 104 one wall at a time, starting with the collapsible wall immediately adjacent to top cylindrical wall 104*a* to achieve the desired heel-height. Controller element 300 provides the user with precise step-wise control over heel height adjustment mechanism 400 by providing for the collapse of one cylindrical wall section 104 at a time. To ensure that height-adjustable heel 100 remains fixed in place at the user's chosen height, controller element may include a safety control feature requiring the user to initiate a specific activation procedure to enable the collapsing or de-collapsing of collapsible walls 104, whichever the case may be.

The material comprising outer skin element 200 is comprised of a strong, flexible, and compressible material capable of undergoing repeated reversible deformation with no substantial effect on its tensile strength during the simultaneous collapsing or de-collapsing of the wall sections 104 to which it is affixed. Graphene or a graphene synthetic plastic composite is an example material meeting these requirements because both are capable of conducting electricity and possesses excellent tensile strength. Graphene's stretchability, electrical conducting properties, and fabricating compatibility with non-conducting materials polymeric materials such as high-density polyethylene propylene (HDPE) make it an attractive material for creating a cost effective conducting composite capable of electronically interacting with APP 300. However, any suitable material that meets height-adjustable heel 100's various structural, weight-bearing, compressibility and interactive APP requirements may serve as outer skin element 200.

The wall sections 104 of skeleton framework element 102 are composed of a strong but collapsible material capable of holding the user's weight no matter what the heel length such as stainless steel, metals, plastic, rubber, or composites of these materials that provide the requisite mechanical and strength requirements. Different wall sections 104 may be comprised of different types of materials to further meet the height-adjustable heel 100's strength requirements through all heel heights. The material comprising outer skin element 200 may also be consideration in selecting the composition of skeleton framework element 102 since both the composition of cylindrical wall sections 104 and outer skin layer 200 contribute to the strength of height-adjustable heel 100. Anchoring wall elements 130 and 160 are comprised of suitable strong materials such as hard plastic, metal, alloys, plastic composites. Platform 150 is comprised of the materials generally used to manufacture of platform-containing shoes and selected to retain the required conformation of cylindrical compartment 155 which is provided within platform 155.

Adjustable heel 100 is further adapted to provide fine-timed heel height adjustments via remote control 400 or APP 500 which may be particularly desirable where one of the user's legs is shorter than the other. Height-adjustable heel 100 with a plurality of collapsible walls 104 may better meet the user's needs and preferences by providing more height adjustment options. Also, the shorter the lengths of collapsible wall sections 104, the greater the ability of the user to separately fine-tune the heights of the two heels comprising a pair of smart shoes 10.

Figure 6A:
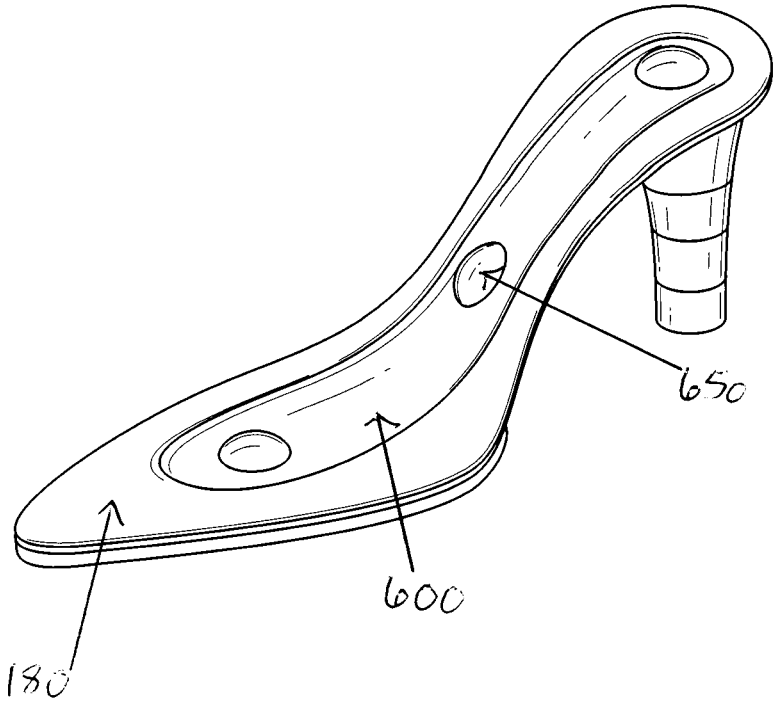
FIG. 6A is side planar view showing the inside of the smart shoe with one comfort pressure point pad affixed to the smart shoe's inner sole.
Figure 6B:
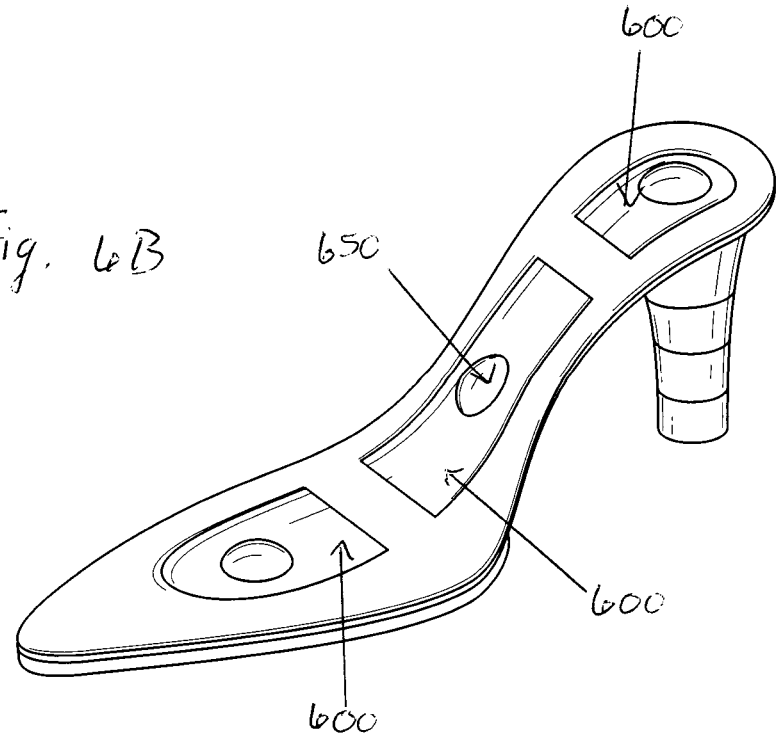
FIG. 6B is a perspective view of the smart shoe showing an automatic width adjustment pad on one side of the interior of the shoe.

Referring now to FIG. 6A, smart shoe 10 optionally includes one or a plurality of pressure-point relieving pads 600 affixed to a predetermined position(s) atop the smart shoe 10's insole at preselected locations. For the purposes of this invention, insole 180 is defined as the layer of material applied during a shoe's construction that lays on top of the shoe's insole, i.e., the part of the shoe where the bottom of the foot contacts a shoe. Pads 600 sit atop a small battery-operated internal air pump 510 for inflating the pad if desired and a small sensor 550 for monitoring the inflation and deflation of pad 600. Internal air pump 610 and internal sensor 650 are preferably positioned under each optional pad 600 in a holding space 630 provided in the underlying area of the smart shoe's mid-sole defined as the layer(s) of cushioned material between the innersole and outer sole. Upon activation by remote controller 400 or APP 500, air fills the immediate space under pad 500, causing the expansion of pad 500 above the insole to provide an air-filled pad. Upon deactivation, the air is released and 600 returns to its flat position. When in their unraised position, pad(s) are substantially contiguous with the insole to provide a smooth insole surface as in a regular shoe. A USB port may be positioned within pad 600 to provide for battery recharging via a USB cord. The USB port is preferably covered with a flap of material to protect it when not in use (no shown).

One of the most annoying problems with high heels is their tendency to cause the user's heel to "lift up" out of the heel cup because of fit problems. Heel cup is defined as the back area of the shoe where the user's heel fits. As discussed above, shoes are generally sold on the basis of foot length and width. However, a large percentage of the population has feet that are not equivalent in size. One remedy is to purchase pair of shoes a half size larger. However, this approach only helps the "larger" foot. To keep the matching shoe on the smaller foot, the shoe wearer may need to squeeze her toes into the shoe's toe cap to try and keep the "loose" shoe on her foot.

Figure 7:
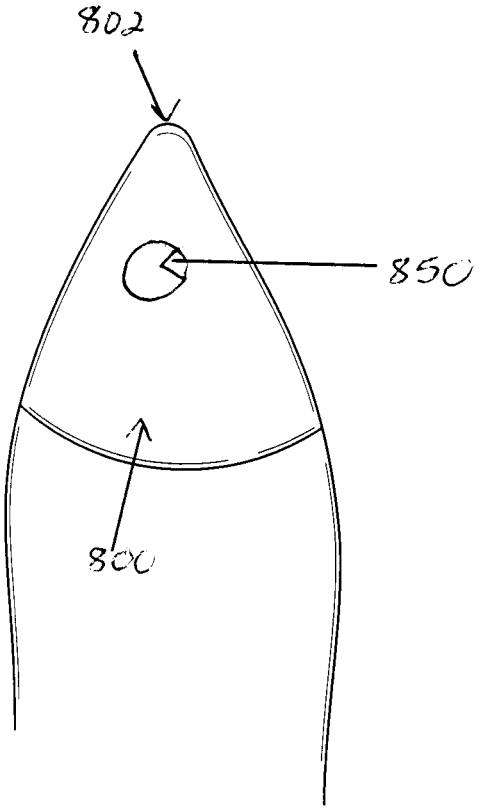
FIG. 7 is a front planar view of the inside surface of the smart shoe's heel cup showing the smart shoe's length adjustment pad.
Figure 8:
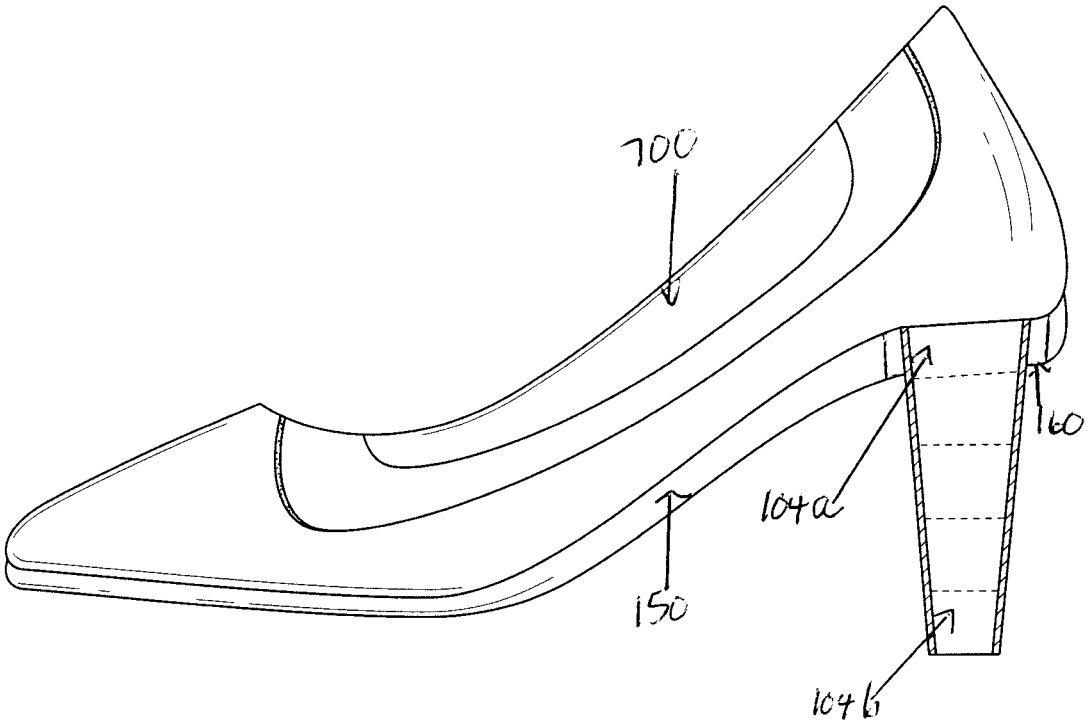
FIG. 8 is a side perspective cross-sectional view of the smart shoe showing the internal wall anchoring element contained within the smart shoe's platform.

Referring now to FIG. 7, in an embodiment smart shoe 10 optionally includes an adjustable shoe length adjustment pad 800 positioned in the center of the back side 804 of the shoe's heel cup 810 comprising a small internal battery-operated air pump 820 and sensor 850. Internal air pump 820 and internal sensor 850 are preferably positioned length within length adjustment pad 800 holding cell provided in heel cup 810. Upon activation by remote controller 400 or APP 500, air fills the space under pad 800, causing the expansion of pad 800 into the surrounding interior of smart shoe 10. This feature allows the wearer to fine-tune the inside length of both shoes commensurate with the actual lengths of her feet to prevent her from lifting her foot out of the shoe's heel cup while walking. A USB port 806 may be positioned within pad 800 to provide for battery recharging with an appropriate USB cord. If present, USB port 806 is preferably covered with a flap of material to protect it when not in use (not shown).

Referring now to FIG. 6A, most shoes are sold as B width shoes despite the fact that many shoe wearers actually have narrower feet. Again, finding the "perfect" shoe size can be difficult. Smart shoe 10 includes one or more width reduction pads 900 included on the inside surface of one or both sides of the shoe. An internal battery-operated air pump 902 and a sensor 904 are located under the width reduction pad(s) 900 being incased within a holding cell 906 contained with the side of smart shoe under each of any included reduction pad 900. Smart shoe 10 provides for adjustments related to the narrowing of the shoe's width to better accommodate the shape of the user's feet. A USB port 906 may be included to provide for battery recharging with a USB cord. If included, USB port 906 is preferably covered with a flap of material to protect it when not in use (not shown).

Figure 11:
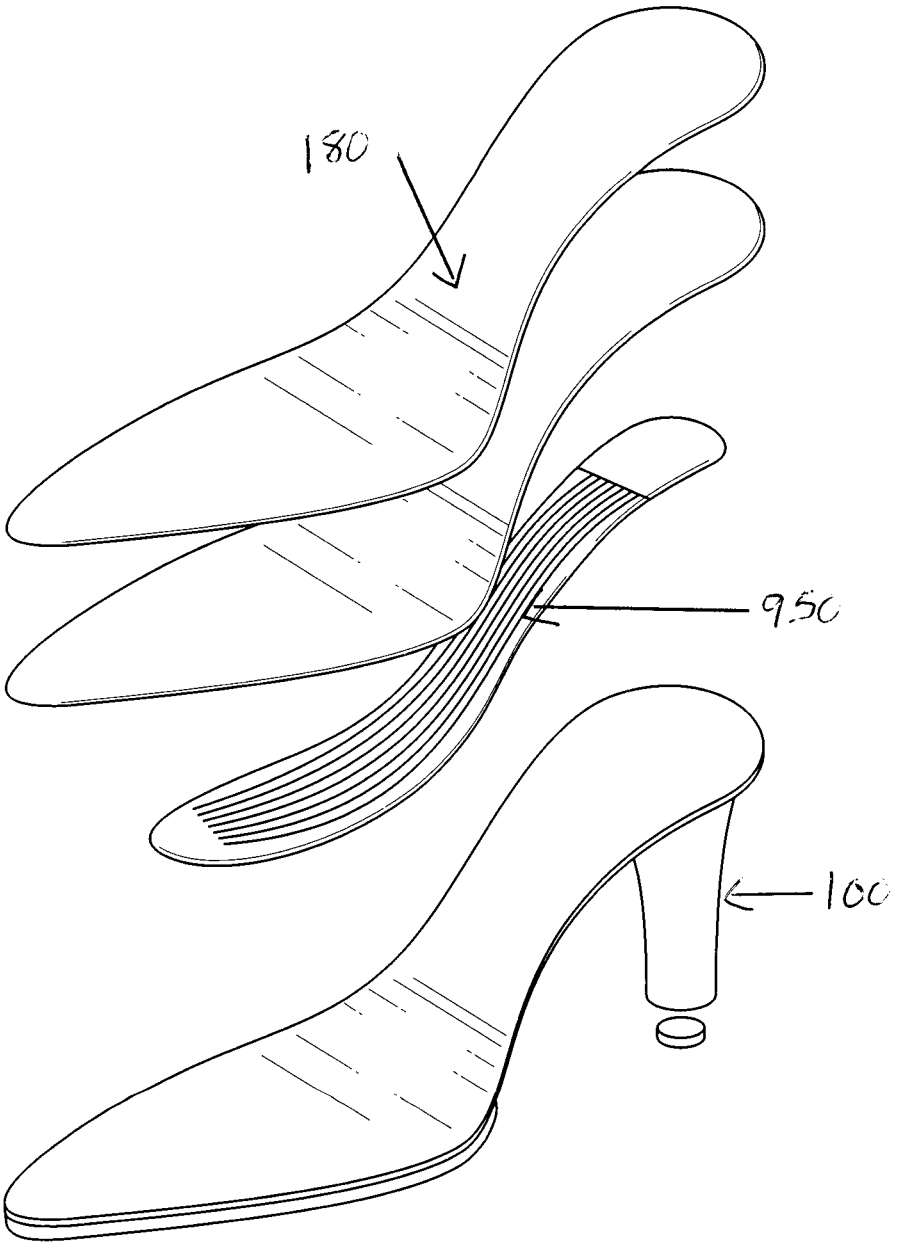
FIG. 11 is a side perspective view of a cross section of the shoe showing the embodiment of the smart shoe having an adjustable arch support.

Referring now to FIG. 11, in another embodiment, smart shoe 10 optionally includes an automatically longitudinal adjustable arch support section 950 in the area of smart shoe 10's insole 180 which is designed to support the arch of the shoe wearer's particularly for those individuals with a medium or high arch. A consideration for adjustable arch support segment 950 is that it will retain its shape if smart shoe user 10 wishes to avail herself of this option. Arch support segment 950 provides the user with the option to automatically raise the segment of insole 180 which is substantially aligned with the wearer's foot arch to provide comfortable support for her foot arch if so desired which otherwise would not be in direct contact with smart shoe's insole segment 180. Referring to FIG. 13, arch support segment 950 covers a holding cell 906 positioned under it within smart shoe's middle sole, defined as the layer(s) of cushioned material between smart shoe 10's innersole 180 and outer sole. Internal battery-operated air pump 902 and a sensor 904 are located within holding cell 106. Upon activation by remote controller 400 or APP 500, air causes the upward expansion of arch support segment 950 above the insole to provide an air-filled arch support 970 to a height selected by the shoe wearer. The shoe wearer may use the remote controller 400 or APP 500 to switch off battery operated pump 903 at any time to initiate the deflation of arch support segment 950. When in its unraised position, arch support 900 is substantially contiguous with insole 180 to provide a smooth insole surface as in a regular shoe. A USB port may be positioned within arch support 900 to provide for battery recharging via a USB cord.

Figure 12:
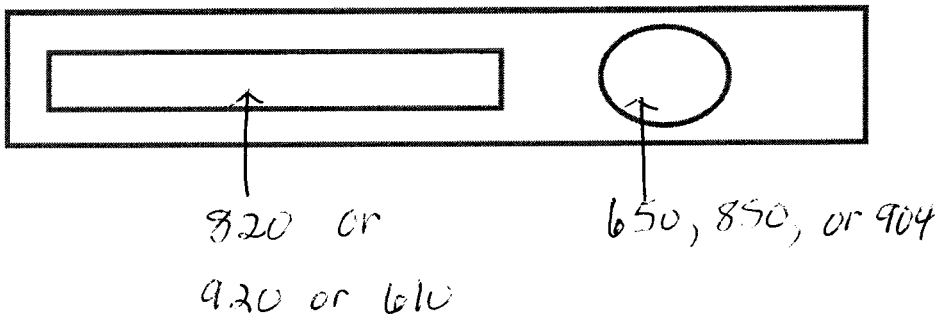
FIG. 12 is a side planar view of the smart shoe's automatic width, length, comfort, and arch support automatic adjustment system, such a system being provided for each adjustment pad.

FIG. 12 illustrates the automated mechanisms described for comfort pads 600, length adjustment pad 700, and width adjustment pad 800, all being controlled by an internal-battery operated air pump and having a sensor to monitor the inflated pads' position.

Referring again to Fig.14, the smart shoe 10's controller 300 provided as either remote control 400 or APP 500 provides for automatic heel height adjustment, shoe length adjustment, shoe width adjustment, arch support adjustment, and comfort adjustments to provide a smart shoe which resolves all of the common complaints of the average high heel wearer. Smart shoe 10 may also be provided with height-adjustable heel 100 only or with height-adjustable heel 100 and one or more of the adjustments related to shoe fit. That is, smart shoe 10 may be provided with its available utilities tailored to the wearer's preferences.

When controller 300 is provided as APP 500, the user's shoe adjustment history from heel height adjustments to pad adjustments to arch support adjustments is saved. APP 500 may also be used to store the user's foot-related medical information at the user's option. For example, after the first adjustment, the user may simply choose to repeat that adjustment which is stored in the APP's memory.

In another embodiment, the APP includes a data input option 1000 where the wearer can input weather conditions, the distance she plans to walk, the walking surfaces she will be encountering, existing weather conditions, and other environmental information. APP 500's algorithm analyzes the inputted data to suggest preferred adjustments (e.g., heel height adjustments) to ensure the user's safety and comfort commensurate with her medical foot history, weight, height, weather conditions, walking surfaces, and the like to provide recommended adjustment.

Directional terms such as "front", "back", "in", "out", "downward", "upper", "lower", "top", "bottom", "proximal" or "distal" and the like may have been used in the description. These terms are Applicable to the embodiments shown and described in conjunction with the drawings. The terms are merely used for the purpose of description in connection with the drawings and do not necessarily Apply to the position in which the multi-washer Apparatus may be used.

While the invention has been described with reference to various embodiments, it will be understood by those skilled in the art that various changes may be made and equivalents may be substituted for elements thereof without departing from the scope of the invention. In addition, many modifications could be made to adapt a particular situation or material to the teachings of the invention without departing from the essential scope of the invention thereof. It is therefore intended that the invention not be limited to the particular embodiment disclosed as the best more contemplated for carrying out the invention but that the invention will include all embodiments falling within the scope of the disclosure.

I claim:

1. A smart shoe comprising an automatically controlled height-adjustable heel affixed to a heel base wherein the height-adjustable heel includes a skeleton framework element, an external collapsible wall anchoring element, a skin element, an automated mechanical system, and a programmable controller element, the skeleton framework element further comprising a plurality of concentric, coaxially oriented, reversibly electronically collapsible, substantially cylindrical wall sections, the cylindrical wall sections being fully extendable from a collapsed position, the cylindrical wall sections having an automatically collapsible and extendable lateral side of a selected length with an inner surface separated from an outer surface by a gap encasing at least one pair of oppositely disposed vertically automatically adjustable cords wherein the plurality of cylindrical wall sections includes one top cylindrical wall section having a solid top side with an exterior surface and interior surface, one bottom cylindrical wall section having a solid base, and one or more middle cylindrical wall sections, the plurality of cylindrical wall sections exhibiting progressively smaller diameters from the top cylindrical wall section to the bottom cylindrical wall section;

the external wall anchoring element further comprising a substantially cylindrical chamber having a selected fixed length and a selected diameter having a solid top face with an outer surface and an inner surface, and a bottom opening wherein the top face's outer surface is affixed to the smart shoe's heel base and the top face's inner surface is affixed to the exterior surface of the skeleton framework element's top cylindrical wall section;

the skin element covering substantially the entire outer surface of the plurality of cylindrical wall sections;

the automated mechanical system comprising a roller affixed within the skeleton framework element having a rechargeable wireless motor for providing the automatic shortening or lengthening of the pair of cords to provide for the simultaneous shortening of a selected cylindrical wall section;

and the programmable controller element providing the heel adjustment mechanism causing the automatic collapsing or extension of the cylindrical wall sections via the automated mechanical system.

2. The smart shoe of claim 1 wherein the inner and outer surfaces of the top, bottom and middle cylindrical wall sections further comprise sensors capable of responding to electronic signals from the programmable controller element to monitor the position of the cylindrical wall sections following their collapse or extension.

3. The smart shoe of claim 1 wherein the anchoring compartment's cylindrical chamber houses at least a portion of the top cylindrical wall section's length when the height-adjustable heel is fully extended.

4. The smart shoe of claim 1 wherein the anchoring compartment's cylindrical chamber houses the top cylindrical wall section and all collapsed cylindrical wall sections wall section when the hollow skeleton element is electronically shortened by controller element to a selected length.

5. The smart shoe of claim 1 wherein every collapsed cylindrical wall section is substantially enclosed within a previously collapsed wall section.

6. The smart shoe of claim 1 wherein the height-adjustable heel's height is substantially equal to the sum of the total adjustable length of any uncollapsed cylindrical wall sections and the selected fixed length of the cylindrical wall section anchoring compartment.

7. The smart shoe of claim 1 wherein the bottom cylindrical wall section's solid base further comprises a top piece wherein the top piece solely provides for direct contact between the height-adjustable heel and a walking surface when the bottom cylindrical wall is not itself collapsed.

8. The smart shoe of claim 1 wherein the cylindrical wall anchoring element's selected length comprises the adjustable-heel element's shortest achievable height when all reversibly collapsible wall sections have been collapsed including the bottom cylindrical wall.

9. A smart shoe comprising a platform with a hollow cylindrical compartment and an automatically controlled height-adjustable heel affixed to the platform's hollow cylindrical compartment wherein the height-adjustable heel including a skeleton framework element, an internal collapsible wall anchoring element, a skin element, an automated mechanical system, and a programmable controller element, the skeleton framework element further comprising a plurality of concentric, coaxially oriented, reversibly electronically collapsible, substantially cylindrical wall sections, the cylindrical wall sections being fully extendable from a collapsed position, the cylindrical wall sections having an automatically collapsible and extendable lateral side of a selected length with an inner surface separated from an outer surface by a gap encasing at least one pair of oppositely disposed vertically automatically adjustable cords wherein the plurality of cylindrical wall sections includes one top cylindrical wall section having a solid top side with an exterior surface and interior surface, one bottom cylindrical wall section having a solid base, and one or more middle cylindrical wall sections, the plurality of cylindrical wall sections exhibiting progressively smaller diameters from the top cylindrical wall section to the bottom cylindrical wall section;

the internal wall anchoring element further comprising a substantially cylindrical chamber having a selected fixed length and a selected diameter having a solid top face with an outer surface and an inner surface, and a bottom opening wherein the top face's outer surface is affixed to the smart shoe's heel base and the top face's inner surface is affixed to the exterior surface of the skeleton framework element's top cylindrical wall section;

the skin element covering substantially the entire outer surface of the plurality of cylindrical wall sections;

the automated mechanical system comprising a roller affixed within the skeleton framework element having a rechargeable wireless motor for providing the automatic shortening or lengthening of the pair of cords to provide for the simultaneous shortening of a selected cylindrical wall section;

and the programmable controller element providing for the automatic collapsing and extension of the cylindrical wall sections via the automated mechanical system.

10. The smart shoe of claim 9 wherein the inner and outer surfaces of the top, bottom and middle cylindrical wall sections further comprise sensors capable of responding to electronic signals from the programmable remote-control element to provide for the electronically controlled collapse or extension of a single cylindrical wall section at a time.

11. The smart shoe of claim 9 wherein the adjustable-heel element's height is substantially equal to the sum of the total length of the uncollapsed cylindrical wall sections.

12. The smart shoe of claim 9 wherein the wall anchoring element's chamber houses the top cylindrical wall section and all collapsed cylindrical wall sections wall section when the height-adjustable heel is electronically shortened to a selected height.

13. The smart shoe of claim 9 wherein every collapsed cylindrical wall section is substantially enclosed within all previously collapsed wall section.

14. The smart shoe of claim 9 wherein the height-adjustable heel's height is substantially equal to the sum of the total length of any uncollapsed cylindrical wall sections.

15. The smart shoe of claim 9 wherein the bottom cylindrical wall section's solid base comprises a top piece wherein the top piece solely provides for direct contact between the height-adjustable heel and a walking surface for all selected heights not requiring the collapse of the bottom cylindrical wall section.

16. The smart shoe of claim 12 wherein the adjustable-height heel's flat conformation comprises a top piece wherein the top piece consists of the bottom cylindrical wall section's solid base centered within previously collapsed wall sections, all collapsed wall sections being substantially level with the hollow platform's base.

17. The smart shoe according to claim 1 or 9 wherein the smart shoes has an electronically controlled smart shoe length modifier further comprising an electronically expandable cushion affixed to the inside surface of said smart shoe's heel stop atop a holding cell positioned in the smart shoe's middle sole under the inner sole, the holding cell containing a sensor and a battery operated air pump.

18. The smart shoe according to claim 1 or 9 wherein the smart shoe has an electronically controllable smart shoe width modifier element further comprising a substantially expandable cushion affixed to the inside surface of one or both sides of the smart shoe, the side being adapted to include a holding cell housing a sensor and a battery operated air pump.

19. The smart shoe according to claim 1 or 9 wherein the smart shoe has an electronically controllable smart shoe arch support modifier element further comprising an expandable arch support segment comprising an expandable material capable of supporting a foot arch, the segment positioned atop the smart shoe's middle insole under the inner sole, the holding cell containing a sensor and battery operated air pump.

20. The system according to claim 1 or 9 wherein the controller element is capable of sending signals to and receiving heel height adjustment data from selected sensors over a wireless network to provide for the shortening of or extension of the heel through the selective collapse of one section of the heel into the immediately upper adjacent section or the selective extension of the last section to have been collapsed; the smart shoe's length adjustment through the expansion or retraction of the length modifier; the smart shoe's width adjustment through the expansion or retraction of the width modifier; and the smart shoe's arch support through the expansion or retraction of the arch support modifier according to a user's adjustment selections.

21. The system according to claim 1 or 9 wherein the communicating between the controller element and the smart shoe's sensors and the wireless batter operated roller is over a wireless network.

22. The system according to claim 2 or 10 wherein controller element's communicating with the smart shoe's sensors is commenced when the user activates the controller element and selects from a plurality of height adjustment, width adjustment, length adjustment, and arch support adjustment options viewable on a controller-user interface.

23. The system according to claim 1 or 9 wherein the controller element further comprises a storage capacity for retaining the smart shoe's cumulative adjustment data according to the user's smart shoe usage adjustment history.

* * * * *